US008205815B2

(12) United States Patent
Cai et al.

(10) Patent No.: US 8,205,815 B2
(45) Date of Patent: Jun. 26, 2012

(54) PAPER ALIGNMENT SENSOR ARRANGEMENT

(75) Inventors: Qingcheng Cai, Suzhou (CN); Michael D. Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 385 days.

(21) Appl. No.: 12/466,775

(22) Filed: May 15, 2009

(65) Prior Publication Data

US 2010/0288861 A1 Nov. 18, 2010

(51) Int. Cl.
*B02C 25/00* (2006.01)

(52) U.S. Cl. ..... 241/33; 241/36

(58) Field of Classification Search ..... 241/33, 241/36

See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Hosokawa et al. |
| 3,724,766 | A | 4/1973 | Bosland |
| 3,764,819 | A | 10/1973 | Muller |
| 3,785,230 | A | 1/1974 | Lokey |
| 3,829,850 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,378,717 | A | 4/1983 | Schneider et al. |
| 4,489,897 | A | 12/1984 | Turner |
| 4,495,456 | A | 1/1985 | Vercillo et al. |
| 4,497,478 | A | 2/1985 | Reschenhofer |
| 4,683,381 | A | 7/1987 | Dufoug |
| 4,707,704 | A | 11/1987 | Allen |
| 4,757,949 | A | 7/1988 | Horton |
| 4,814,632 | A | 3/1989 | Glaeser |
| 4,815,669 | A | 3/1989 | Fujii |
| 4,842,205 | A | 6/1989 | Araki |
| 4,889,291 | A | 12/1989 | Goldhammer et al. |
| 4,890,797 | A | 1/1990 | Fujii et al. |

(Continued)

FOREIGN PATENT DOCUMENTS

| | | |
|---|---|---|
| DE | 3313232 | 10/1984 |

(Continued)

OTHER PUBLICATIONS

Complaint for Declaratory Judgment filed on Nov. 15, 2010 by Royal Applicance Manufacturing Co., d/b/a/ TTI Floor Care North America and Techtronic Industries Co. Ltd. against Fellowes, Inc.

(Continued)

*Primary Examiner* — Faye Francis

(74) *Attorney, Agent, or Firm* — Pillsbury Winthrop Shaw Pittman LLP

(57) ABSTRACT

A shredder includes a housing having a throat for receiving at least one article to be shredded and a shredder mechanism received in the housing. The shredder mechanism includes a motor and cutter elements, and enables the articles to be shredded to be fed into the cutter elements. The motor is operable to drive the cutter elements so that the cutter elements shred the articles into shredded particles. The shredder also includes a plurality of sensors provided along the throat for sensing articles. A controller is coupled to the motor and the sensors, the controller being configured to perform a predetermined motor control operation of the motor responsive to the sensors sensing the articles inserted into the throat at an angle above a predetermined angle threshold or the sensors sensing with a predetermined sensing pattern the at least one rectangular sheet of paper inserted into the throat.

56 Claims, 10 Drawing Sheets

U.S. PATENT DOCUMENTS

| | | | |
|---|---|---|---|
| 4,914,721 | A | 4/1990 | Glaeser |
| 5,017,972 | A | 5/1991 | Daughton |
| 5,081,406 | A | 1/1992 | Hughes et al. |
| 5,139,205 | A | 8/1992 | Gallagher et al. |
| 5,166,679 | A | 11/1992 | Vranish et al. |
| 5,167,374 | A | 12/1992 | Strohmeyer |
| 5,186,398 | A | 2/1993 | Vigneaux, Jr. |
| 5,198,777 | A | 3/1993 | Masuda et al. |
| 5,342,033 | A | 8/1994 | Iwata |
| 5,345,138 | A | 9/1994 | Mukaidono et al. |
| 5,353,468 | A | 10/1994 | Yap |
| 5,397,890 | A | 3/1995 | Schueler et al. |
| 5,409,171 | A | 4/1995 | Stangenberg et al. |
| 5,415,355 | A | 5/1995 | Gollwitzer |
| 5,429,313 | A | 7/1995 | Schwelling |
| 5,453,644 | A | 9/1995 | Yap |
| 5,494,229 | A | 2/1996 | Rokos |
| 5,539,322 | A | 7/1996 | Zoughi et al. |
| 5,662,280 | A | 9/1997 | Nishio et al. |
| 5,743,521 | A | 4/1998 | Munakata et al. |
| 5,772,129 | A | 6/1998 | Nishio et al. |
| 5,775,605 | A | 7/1998 | Tsai |
| 5,823,529 | A | 10/1998 | Mandel |
| 5,850,342 | A | 12/1998 | Nakamura et al. |
| 5,871,162 | A | 2/1999 | Rajewski |
| 5,924,637 | A | 7/1999 | Niederholtmeyer |
| D412,716 | S | 8/1999 | Kroger |
| 5,942,975 | A | 8/1999 | Sorensen |
| D414,198 | S | 9/1999 | Iwata |
| 5,988,542 | A | 11/1999 | Henreckson |
| 6,065,696 | A | 5/2000 | Tsai |
| D426,805 | S | 6/2000 | Iwata |
| 6,079,645 | A | 6/2000 | Henreckson et al. |
| 6,116,528 | A | 9/2000 | Schwelling |
| 6,141,883 | A | 11/2000 | Mitchell et al. |
| 6,265,682 | B1 | 7/2001 | Lee |
| 6,376,939 | B1 | 4/2002 | Suzuki et al. |
| 6,418,004 | B1 | 7/2002 | Mather et al. |
| 6,550,701 | B1 | 4/2003 | Chang |
| 6,561,444 | B1 | 5/2003 | Yokomine et al. |
| 6,601,787 | B1 | 8/2003 | Langenecker |
| 6,655,943 | B1 | 12/2003 | Peterson |
| 6,666,959 | B2 | 12/2003 | Uzoh et al. |
| 6,676,460 | B1 | 1/2004 | Motsenbocker |
| 6,698,640 | B2 | 3/2004 | Hakozaki |
| 6,724,324 | B1 | 4/2004 | Lambert |
| 6,802,465 | B1 | 10/2004 | Norcott et al. |
| 6,979,813 | B2 | 12/2005 | Avril |
| 6,983,903 | B2 | 1/2006 | Chang |
| 6,997,408 | B2 | 2/2006 | Watano |
| 7,025,293 | B2 | 4/2006 | Matlin et al. |
| 7,040,559 | B2 | 5/2006 | Matlin |
| 7,166,561 | B2 | 1/2007 | Allen |
| 7,213,780 | B2 | 5/2007 | Chen |
| 7,311,276 | B2 | 12/2007 | Matlin et al. |
| 7,490,786 | B2 | 2/2009 | Matlin et al. |
| 7,520,452 | B2 | 4/2009 | Watano et al. |
| 7,584,545 | B2 | 9/2009 | Pan et al. |
| 7,624,938 | B2 | 12/2009 | Aries et al. |
| 7,631,822 | B2 | 12/2009 | Matlin et al. |
| 7,631,823 | B2 | 12/2009 | Matlin et al. |
| 7,631,824 | B2 | 12/2009 | Matlin et al. |
| 7,635,102 | B2 | 12/2009 | Matlin et al. |
| 7,661,614 | B2 | 2/2010 | Matlin et al. |
| 7,663,769 | B2 | 2/2010 | Hayashihara et al. |
| 7,712,689 | B2 | 5/2010 | Matlin et al. |
| 2003/0042342 | A1 | 3/2003 | Kroger et al. |
| 2004/0008122 | A1 | 1/2004 | Michael |
| 2004/0069883 | A1 | 4/2004 | Watanabe et al. |
| 2004/0159198 | A1 | 8/2004 | Peot et al. |
| 2004/0194594 | A1 | 10/2004 | Dils et al. |
| 2004/0226800 | A1 | 11/2004 | Pierga |
| 2005/0150986 | A1 | 7/2005 | Castronovo |
| 2006/0016919 | A1 | 1/2006 | Castronovo |
| 2006/0054725 | A1 | 3/2006 | Matlin |
| 2006/0091247 | A1 | 5/2006 | Matlin |
| 2006/0219827 | A1 | 10/2006 | Matlin et al. |
| 2006/0243631 | A1 | 11/2006 | Duke |
| 2007/0007373 | A1 | 1/2007 | Matlin et al. |
| 2007/0025239 | A1 | 2/2007 | Jain et al. |
| 2007/0063082 | A1 | 3/2007 | Coleman |
| 2007/0080252 | A1 | 4/2007 | Pierce |
| 2007/0087942 | A1 | 4/2007 | Allen |
| 2007/0164135 | A1 | 7/2007 | Zhong |
| 2007/0164138 | A1 | 7/2007 | Allen |
| 2007/0215728 | A1 | 9/2007 | Priester |
| 2007/0221767 | A1 | 9/2007 | Matlin |
| 2007/0221768 | A1* | 9/2007 | Wang ..... 241/101.3 |
| 2007/0246582 | A1 | 10/2007 | Aries et al. |
| 2008/0093487 | A1 | 4/2008 | Lee |
| 2008/0231261 | A1 | 9/2008 | Dengler et al. |
| 2008/0245908 | A1* | 10/2008 | Romanovich et al. ..... 241/33 |
| 2009/0025239 | A1 | 1/2009 | Pan |
| 2009/0032629 | A1 | 2/2009 | Aries et al. |
| 2009/0090797 | A1 | 4/2009 | Matlin et al. |
| 2010/0051731 | A1 | 3/2010 | Matlin et al. |
| 2010/0084496 | A1 | 4/2010 | Matlin et al. |
| 2010/0102153 | A1 | 4/2010 | Matlin et al. |
| 2010/0134805 | A1 | 6/2010 | Pan |
| 2010/0170967 | A1 | 7/2010 | Jensen et al. |
| 2010/0170969 | A1 | 7/2010 | Jensen et al. |
| 2010/0176227 | A1 | 7/2010 | Davis et al. |
| 2010/0181398 | A1 | 7/2010 | Davis et al. |
| 2010/0213296 | A1 | 8/2010 | Sued et al. |
| 2010/0213297 | A1 | 8/2010 | Sued et al. |
| 2010/0213300 | A1 | 8/2010 | Matlin et al. |
| 2010/0243774 | A1 | 9/2010 | Hu et al. |
| 2010/0252661 | A1 | 10/2010 | Matlin et al. |
| 2010/0252664 | A1 | 10/2010 | Matlin et al. |
| 2010/0270404 | A1 | 10/2010 | Chen |
| 2010/0282879 | A1 | 11/2010 | Chen |
| 2010/0320297 | A1 | 12/2010 | Matlin et al. |
| 2010/0320299 | A1 | 12/2010 | Matlin et al. |

FOREIGN PATENT DOCUMENTS

| | | |
|---|---|---|
| DE | 8619856.4 | 10/1988 |
| DE | 4121330 | 1/1993 |
| DE | 4207292 | 1/1993 |
| DE | 4237861 | 5/1994 |
| DE | 4437348 | 4/1996 |
| DE | 19835093 | 2/1999 |
| DE | 202004000907 | 5/2005 |
| DE | 102006036136 | 1/2008 |
| DE | 202010001577 U1 | 11/2010 |
| EP | 268244 | 11/1987 |
| EP | 0392867 | 10/1990 |
| EP | 562076 | 9/1992 |
| EP | 524708 | 1/1997 |
| EP | 0792691 | 9/1997 |
| EP | 0818241 | 1/1998 |
| EP | 856945 | 1/1998 |
| EP | 855221 | 7/1998 |
| EP | 1177832 | 2/2002 |
| EP | 1195202 | 4/2002 |
| EP | 2180290 | 7/2008 |
| EP | 2022566 | 2/2009 |
| GB | 1199903 | 7/1970 |
| GB | 2171029 | 8/1986 |
| GB | 2209963 | 6/1989 |
| GB | 2440651 | 2/2008 |
| GB | 2442942 | 4/2008 |
| GB | 2451513 | 2/2009 |
| JP | 52-11691 | 1/1977 |
| JP | 57-070445 | 4/1982 |
| JP | 57-070445 U | 4/1982 |
| JP | 57-76734 | 5/1982 |
| JP | 58-223448 | 12/1983 |
| JP | 61-000702 | 1/1986 |
| JP | 63-173342 | 11/1988 |
| JP | 2-277560 | 11/1990 |
| JP | H2-303550 | 12/1990 |
| JP | 04-157093 | 5/1992 |
| JP | 04-0180852 | 6/1992 |
| JP | 5-96198 | 4/1993 |
| JP | H05-092144 | 4/1993 |
| JP | 6-277548 | 10/1994 |

| | | |
|---|---|---|
| JP | 7-299377 | 11/1995 |
| JP | 8-108088 | 4/1996 |
| JP | 8-131861 | 5/1996 |
| JP | 08-131962 | 5/1996 |
| JP | 08-164343 | 6/1996 |
| JP | 9-38513 | 2/1997 |
| JP | 09-150069 | 10/1997 |
| JP | 9-262491 | 10/1997 |
| JP | 10-048344 | 2/1998 |
| JP | 11-216383 | 8/1999 |
| JP | 11-304942 | 11/1999 |
| JP | 2000346288 | 12/2000 |
| JP | 2002-239405 | 8/2002 |
| JP | 2004-321840 | 11/2004 |
| JP | 2004321993 | 11/2004 |
| WO | 2005070553 | 8/2005 |
| WO | 2006019985 | 2/2006 |
| WO | 2006036370 | 4/2006 |
| WO | 2007109753 | 9/2007 |
| WO | 2007122364 | 11/2007 |
| WO | 2007137761 | 12/2007 |

OTHER PUBLICATIONS

ACCO Rexel, Mainstream 1050/2150/2250/3150/3250 and 3350, 115V Machines Illustrated Parts Lists and Services Instructions, Mar. 25, 2002, Issue No. 4.

ACCO Rexel, Deckside and Office 115V Machines Illustrated Parts Lists and Service Instructions, Aug. 18, 1999.

ACCO Rexel, Deckside and Office 230V Machines Illustrated Parts Lists and Service Instructions, Aug. 1, 2000.

English Translation of Japanese Patent Application Publication No. 9-38513, published on Feb. 10, 1997.

U.S. Appl. No. 60/613,750, filed Sep. 27, 2004, Pierce.

U.S. Appl. No. 60/686,490, filed May 31, 2005, Pierce.

U.S. Appl. No. 60/688,285, filed Jun. 7, 2005, Pierce.

GBC Shredmaster Service Manual, Part #6001054, referencing Models 2230S and 2250X Paper Shredders, Nov. 1997.

The Stationary and Business Machines—Japan, "DS-4000 by Carl Jimuki K.K.", Jun. 2003.

The Stationary and Business Machines—Japan, "NSE-501CN by Nakabayashi K.K.", Oct. 2004.

* cited by examiner

PAPER ALIGNMENT SENSOR ARRANGEMENT

BACKGROUND OF THE INVENTION

1. Field of the Invention

The present invention relates to shredders for destroying articles, such as documents, compact discs, etc.

2. Description of Related Art

Shredders are well known devices for destroying articles, such as paper, documents, compact discs ("CDs"), expired credit cards, etc. Typically, users purchase shredders to destroy sensitive information bearing articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. A common frustration of users of shredders is to feed misaligned articles into the feed throat, only to have the shredder jam after it has started to shred the papers.

The present invention endeavors to provide a shredder with a feature that determines misfeeds of the paper, particularly papers fed in at an angle that is likely to cause jamming, and then reminds the user to re-insert the paper, so that the paper is properly aligned, to prevent the shredder from jamming. The present invention determines misfeeds using an arrangement of sensors configured to sense the insertion of the paper. In particular, misfeeds are determined by the different time periods in which the sensors sense the articles that are being inserted, the thickness of the articles being inserted, and whether a predetermined number of sensors have sensed the articles that are being inserted.

The assignee of the present application, Fellowes, Inc., has developed thickness sensing technologies for shredders which may be used with the present invention. See U.S. Patent Application Publication Nos. 2006-0219827 A1, 2006-0054725 A1, 2007-0007373 A1 and 2007-0221767 A1, U.S. patent application Publication Ser. No. 11/867,260, and U.S. patent application Ser. No. 12/348,420, each of which is incorporated by reference herein in their entirety.

BRIEF SUMMARY OF THE INVENTION

One aspect of the invention provides a shredder including a shredder housing having a throat for receiving at least one rectangular sheet of paper to be shredded therethrough and a shredder mechanism received in the housing. The shredder mechanism includes a motor and cutter elements, and enables the at least one rectangular sheet of paper to be shredded to be fed into the cutter elements. The motor is operable to drive the cutter elements in a shredding direction so that the cutter elements shred the at least one rectangular sheet of paper fed therein into shredded particles. The shredder also includes a plurality of sensors provided along the throat and configured to sense insertion of the at least one rectangular sheet of paper into the throat. A controller is coupled to the motor and the sensors, the controller being configured to perform a predetermined motor control operation of the motor responsive to the sensors sensing the at least one rectangular sheet of paper inserted into the throat at an angle above a predetermined angle threshold.

Another aspect of the invention provides a shredder including a shredder housing having a throat for receiving at least one rectangular sheet of paper to be shredded therethrough and a shredder mechanism received in the housing. The shredder mechanism includes a motor and cutter elements, and enables the at least one rectangular sheet of paper to be shredded to be fed into the cutter elements. The motor is operable to drive the cutter elements in a shredding direction so that the cutter elements shred the at least one rectangular sheet of paper fed therein into shredded particles. The shredder also includes a plurality of sensors provided along the throat and configured to sense insertion of the at least one rectangular sheet of paper into the throat. A controller is coupled to the motor and the sensors, the controller being configured to perform a predetermined motor control operation of the motor responsive to the sensors sensing with a predetermined sensing pattern the at least one rectangular sheet of paper inserted into the throat.

Another aspect of the invention provides a method performed in a shredder including a shredder housing having a throat for receiving at least one rectangular sheet of paper to be shredded therethrough and a shredder mechanism received in the housing. The shredder mechanism includes a motor and cutter elements, and enables the at least one rectangular sheet of paper to be shredded to be fed into the cutter elements. The motor is operable to drive the cutter elements in a shredding direction so that the cutter elements shred the at least one rectangular sheet of paper fed therein into shredded particles. The shredder also includes a plurality of sensors provided along the throat and configured to sense insertion of the at least one rectangular sheet of paper into the throat. A controller is coupled to the motor and the sensors, the controller being configured to perform a predetermined motor control operation of the motor responsive to the sensors sensing the at least one rectangular sheet of paper inserted into the throat at an angle above a predetermined angle threshold. The method includes sensing with the plurality of sensors insertion of the at least one rectangular sheet of paper into the throat; and performing a predetermined motor control operation of the motor responsive to the sensors sensing the at least one rectangular sheet of paper inserted into the throat at an angle above a predetermined angle threshold.

Another aspect of the invention provides a method performed in a shredder including a shredder housing having a throat for receiving at least one rectangular sheet of paper to be shredded therethrough and a shredder mechanism received in the housing. The shredder mechanism includes a motor and cutter elements, and enables the at least one rectangular sheet of paper to be shredded to be fed into the cutter elements. The motor is operable to drive the cutter elements in a shredding direction so that the cutter elements shred the at least one rectangular sheet of paper fed therein into shredded particles. The shredder also includes a plurality of sensors provided along the throat and configured to sense insertion of the at least one rectangular sheet of paper into the throat. A controller is coupled to the motor and the sensors, the controller being configured to perform a predetermined motor control operation of the motor responsive to the sensors sensing with a predetermined sensing pattern the at least one rectangular sheet of paper inserted into the throat. The method includes sensing with the plurality of sensors insertion of the at least one rectangular sheet of paper into the throat; and performing a predetermined motor control operation of the motor responsive to the sensors sensing with a predetermined sensing pattern the at least one rectangular sheet of paper inserted into the throat.

Other aspects, features, and advantages of the present invention will become apparent from the following detailed description, the accompanying drawings, and the appended claims.

DETAILED DESCRIPTION OF THE INVENTION

Figure 1:
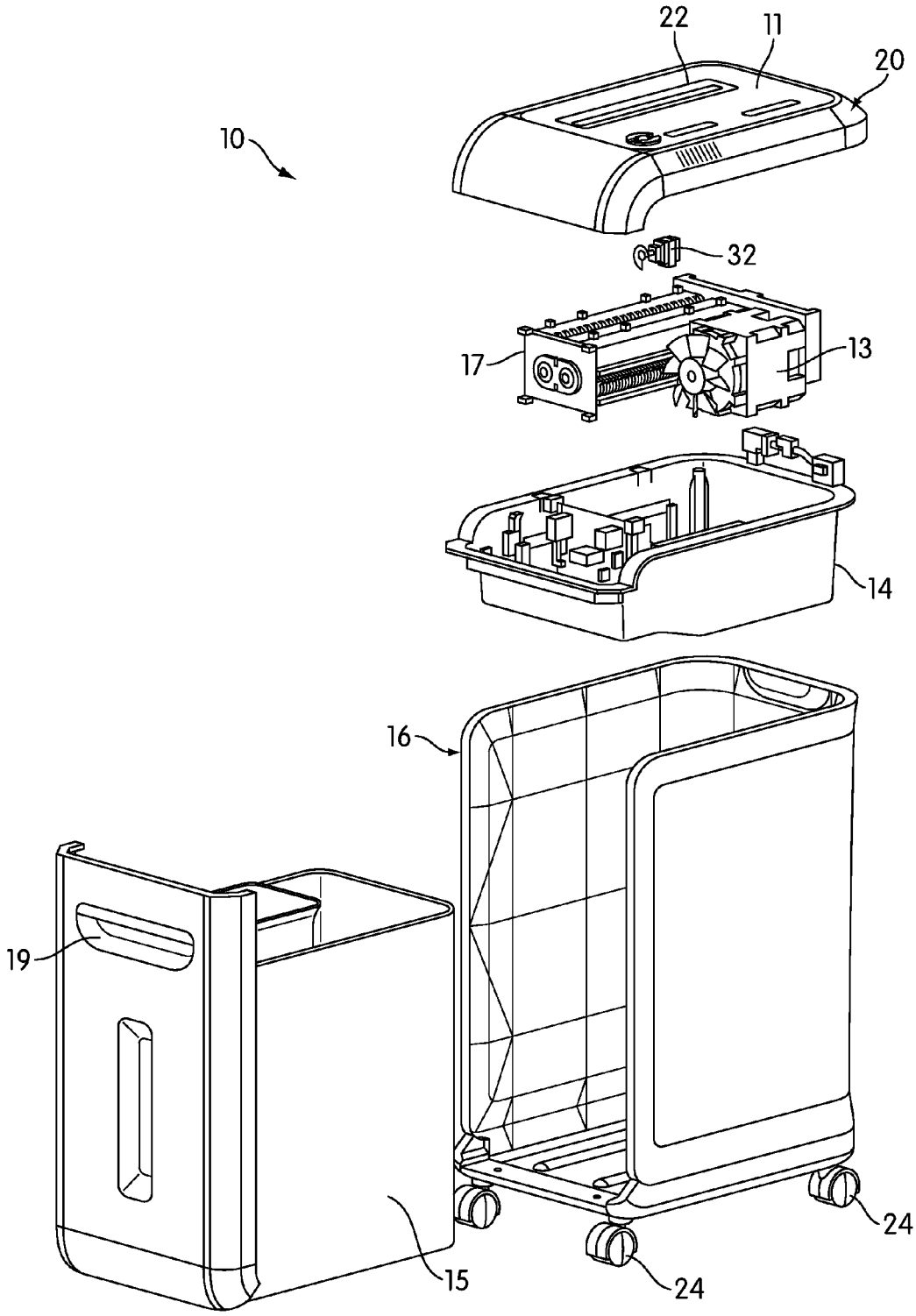
FIG. 1 is an exploded perspective view of a shredder constructed in accordance with an embodiment of the present invention.

FIG. 1 illustrates a shredder 10 constructed in accordance with an embodiment of the present invention. The shredder includes a housing 20 having a throat 22 for receiving at least one article 18 (as shown in FIG. 3), to be shredded, a shredder mechanism 17 received in the housing 16, and a controller 25 (see FIG. 3) coupled to an electrically powered motor 13. The shredder may also include a plurality of sensors, such as thickness sensors 30 and/or alignment sensors 32, connected to the controller 25. The shredder mechanism 17 includes the motor 13 and cutter elements 26 (see FIG. 2). The shredder mechanism 17 enables the at least one article 18 to be shredded to be fed into the cutter elements 26. The motor 13 is operable to drive the cutter elements 26 such that the cutter elements 26 shred the articles 18 fed therein. The sensors 30 and/or 32 are configured to sense the at least one article 18 when the at least one article 18 is received by the throat 22. The controller 25 is configured to perform a predetermined motor control operation of the motor responsive to the sensors 30 and/or 32 sensing the at least one article 18. The term "controller" is used to define a device or microcontroller having a central processing unit (CPU) and input/output devices that are used to monitor parameters from devices that are operatively coupled to the controller 25. The input/output devices also permit the CPU to communicate and control the devices (e.g., such as sensors 30 and/or 32 or the motor 13) that are operatively coupled to the controller 25. As is generally known in the art, the controller 25 may optionally include any number of storage media such as memory or storage for monitoring or controlling the sensors coupled to the controller 25. The controller 25 may be a single integrated controller, or a set of modules each provided for performing one or more specific functions.

FIG. 3 shows the controller 25 capable of controlling the motor 13 that powers the shredder mechanism 17. The sensors 30 and/or 32 are configured to sense the at least one of the articles 18 received by the throat 22 of the shredder 10, and to relay their sensings to the controller 25. In some instances, the articles 18, such as paper, are inserted at an angle into the throat 22, the angle being measured from a plane normal to the bottom edge of the articles 18. When the angle at which the articles 18 are inserted is determined to be above a predetermined angle threshold, the articles 18 are considered to be misaligned or improperly aligned, and are likely to jam the shredder. Upon determining that the angle of insertion is above the predetermined angle threshold indicating that the articles 18 are misaligned, the controller 25 may perform a predetermined motor operation. The controller 25 may be configured to prevent the motor 13 from driving the cutter elements 26 as the predetermined motor operation. The controller 25 may also be configured to reverse the direction of the motor 13 as the predetermined motor operation. This would be performed by using a reversible motor and applying a current that is of a reverse polarity. The capability to operate the motor 13 in a reverse manner is desirable to move the cutter elements 26 in a reversing direction for clearing jams. It is contemplated that there may be more than one predetermined motor operation performed responsive to the sensors 30 and/or 32 sensing misfeeds. The combination and order of the predetermined motor operations performed is not intended to be limiting. Thus, the term "operation" can be broadly considered to be an omission or lack of shredder 10 activity, such as not driving the cutter elements 26 at all, or an active operation, such as reverse driving the cutter elements 26.

Referring back to FIG. 1, the shredder 10 includes the shredder housing 20, mentioned above. The shredder housing 20 includes a top cover or wall 11, and a bottom receptacle 14. The top cover 11 sits atop the upper periphery of the bottom receptacle 14. The top cover or wall 11 is molded from a plastic material or any other material. The shredder housing 20 and its top wall or cover 11 may have any suitable construction or configuration. The top cover or wall 11 has an opening, which is often referred to as the throat 22, extending generally parallel and above the cutter elements 26. The throat 22 enables the articles being shredded to be fed into the cutter elements. As can be appreciated, the throat 22 is relatively narrow, which is desirable for preventing overly thick items, such as large stacks of documents, from being fed into cutter elements 26, which could lead to jamming. The throat 22 may have any configuration.

The shredder 10 includes the bottom receptacle 14 having a bottom wall, four side walls and an open top. The bottom receptacle 14 is molded from a plastic material or any other material. The bottom receptacle 14 sits atop the upper periphery of the bottom housing 20 in a nested relation using flange portions of the bottom receptacle 14 that generally extend outwardly from the side walls thereof. The shredder mechanism 17 along with the motor 13, and the sensors 30 and/or 32 are configured to be received in the bottom receptacle 14 of the shredder housing 20. The bottom receptacle 14 may be affixed to the underside of the top cover or wall 11 by fasteners. The receptacle 14 has an opening in its bottom wall through which the shredder mechanism 17 discharges shredded articles into the container 15.

Figure 2:
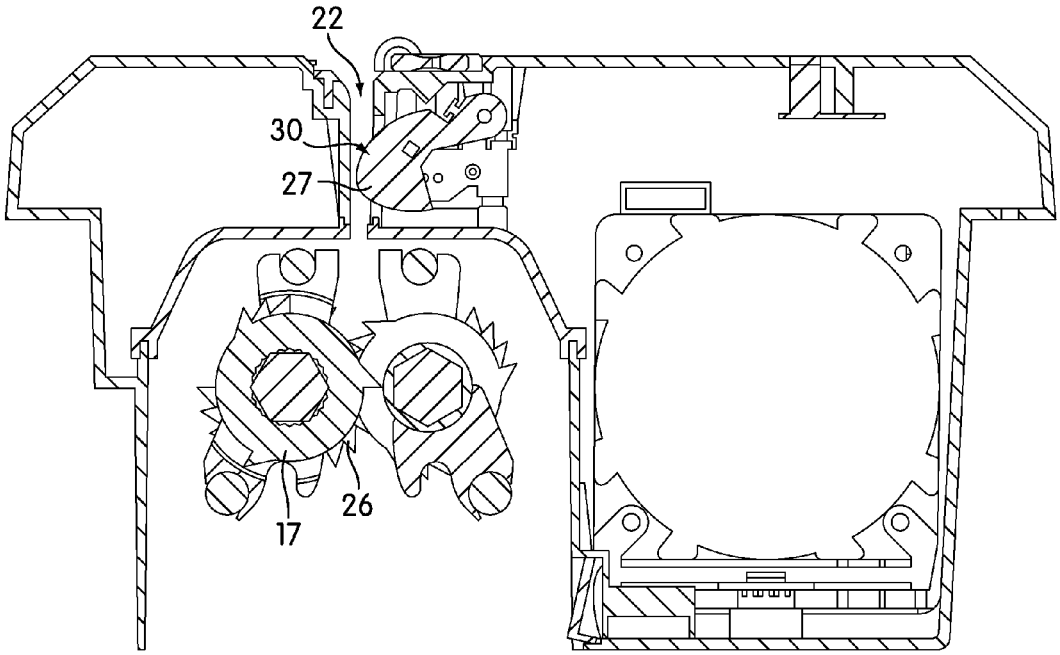
FIG. 2 is a cross-sectional view of the shredder of FIG. 1, wherein a sensor is configured to sense a thickness of an article to be shredded by the shredder in accordance with an embodiment of the present invention.
Figure 3:
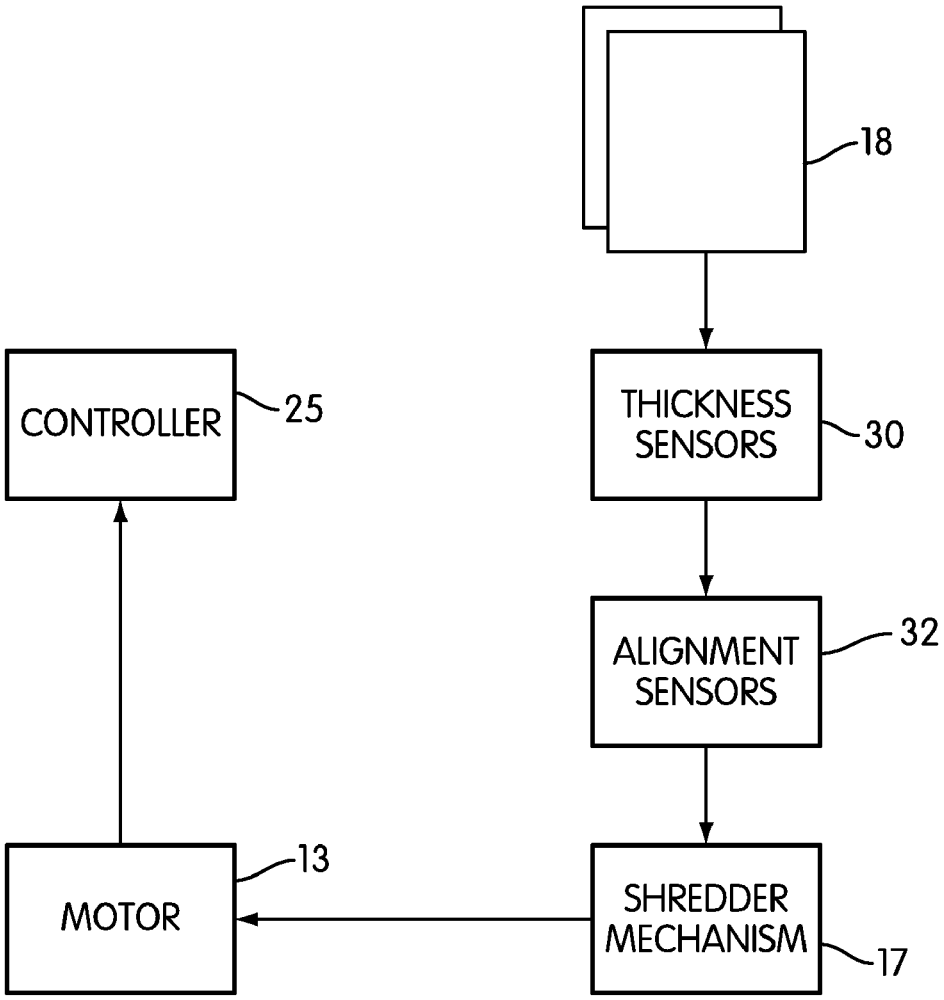
FIG. 3 is schematic illustration of interaction between a controller and other parts of the shredder.

In the embodiment shown in FIG. 2, the shredder 10 includes the shredder mechanism 17 that includes the electrically powered motor 13 and a plurality of cutter elements 26. "Shredder mechanism" is a generic structural term to denote a device that destroys articles using at least one cutter element. Such destroying may be done in any particular way. For example, the shredder mechanism may include at least one cutter element that is configured to punch a plurality of holes in the document or article in a manner that destroys the document or article. In some embodiments, the cutter elements 26 are generally mounted on a pair of parallel rotating shafts. The motor 13 operates using electrical power to rotatably drive the shafts and the cutter elements 26 through a conventional transmission so that the cutter elements 26 shred the articles 18 fed therein. The shredder mechanism 17 may also include a sub-frame for mounting the shafts, the motor 13, and the transmission. The operation and construction of such a shredder mechanism 17 are well known and need not be described herein in detail. Generally, any suitable shredder mechanism 17 known in the art or developed hereafter may be used. As such, the at least one input opening or throat 22 is configured to receive materials inserted therein to feed such materials through the shredder mechanism 17 and to deposit or eject the shredded materials through an output opening (not shown).

In the illustrated embodiment shown in FIG. 1, the shredder 10 may sit atop the large freestanding housing 16, which is formed of molded plastic material or any other material. The housing 16 includes a bottom wall, three side walls, an open front and an open top. The side walls of the housing 16 provide a seat on which the shredder housing 20 is removably mounted. The housing 16 is constructed and arranged to receive the waste container 15 therein. In other words, the waste container 15 is enclosed in the housing 16. The waste container 15 is formed of molded plastic material or any other material. The waste container 15 is in the form of a pull-out bin that is constructed and arranged to slide in and out of the housing 16 through an opening in the front side thereof. The waste container 15 is configured to be removably received within the housing 16. The waste container 15 includes a bottom wall, four side walls, and an open top. The waste container 15 includes a handle 19 that is configured to allow a user to grasp and pull out the waste container 15 from the housing 16. In the illustrated embodiment, the handle 19 is located on the front, side wall of the waste container 15. Any construction or configuration for the housing or waste container may be used, and the illustrated embodiment is not limiting.

As an option, the housing 16 along with the shredder 10 can be transported from one place to another by simply rolling the housing 16 on optional roller members 24, such as wheels or casters. In the illustrated embodiment, the housing 16 includes two pairs of roller members 24 attached to the bottom of the frame of the housing 16 to rollingly support the housing 16. The rolling members 24 can be located on the housing 16 as near the corners as practical. The roller members 24, in one embodiment, may be locked against rolling motion by lock members to provide a stationary configuration. In one embodiment, the front pair of the roller members 24 may be in the form of casters that provide a turning capability to the housing 16, while the rear pair of the roller members 24 may be in the form of wheels that are fixed in direction, so as to only allow roll in the intended direction of travel. In another embodiment, the front and rear pair of the roller members 24 may be in the form of casters.

The cover 11 may include a switch recess with an opening therethrough. An on/off switch (not shown) that includes a switch module may be mounted to the top cover 11 underneath the switch recess by fasteners, and a manually engageable portion that moves laterally within the switch recess. The switch module has a movable element that connects to the manually engageable portion through the opening. This enables movement of the manually engageable portion to move the switch module between its states. An override switch (not shown) that also includes a switch module may also be mounted to the top cover 11.

The switch module is configured to connect the motor 13 to the power supply. This connection may be direct or indirect, such as via a controller 25. Typically, the power supply will be a standard power cord with a plug on its end that plugs into a standard AC outlet. The on/off switch is movable between an on position and an off position by moving the manually engageable portion laterally within the switch recess. In the on position, contacts in the switch module are closed by movement of the manually engageable portion and the movable element to enable a delivery of electrical power to the motor 13. In the off position, contacts in the switch module are opened to disable the delivery of electric power to the motor 13. Alternatively, the switch may be coupled to a controller 25, which in turn controls a relay switch, TRIAC etc. for controlling the flow of electricity to the motor 13.

Generally, the construction and operation of the switch for controlling the motor 13 are well known and any construction for such a switch may be used. For example, the switch need not be mechanical and could be of the electro-sensitive type described in U.S. patent application Ser. No. 11/536,415, which is incorporated herein by reference. Likewise, such a switch may be entirely omitted, and the shredder 10 can be automatically started based on insertion of an article 18 to be shredded. In embodiments in which the shredder 10 can be started based on insertion of an article 18 to be shredded, the override switch may be used to start the shredder 10 manually. This may be useful when activation sensors are used to start the shredders 10, which will be described in detail later.

Generally speaking, the shredder 10 may have any suitable construction or configuration and the illustrated embodiment is not intended to be limiting in any way. In addition, the term "shredder" is not intended to be limited to devices that literally "shred" documents and articles, but is instead intended to cover any device that destroys documents and articles in a manner that leaves each document or article illegible and/or useless.

Figure 4:
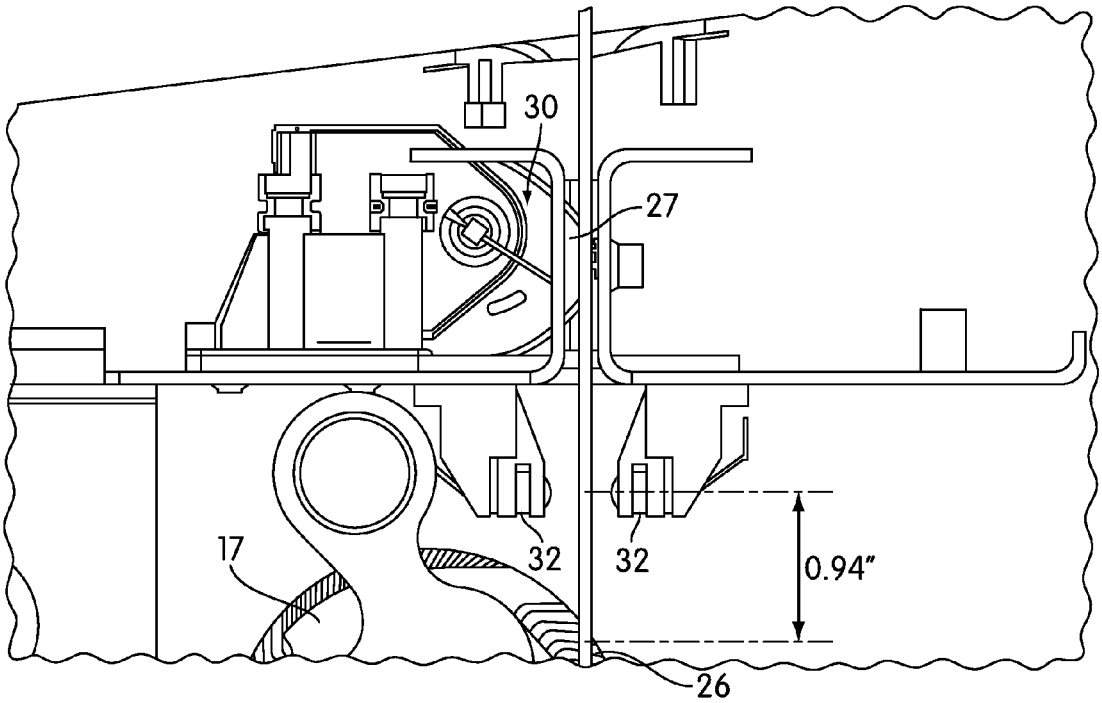
FIG. 4 is a cross-sectional view of an embodiment having a thickness sensor and an alignment sensor.

FIG. 4 shows thickness sensors 30 that may be used to sense the articles (e.g., a compact disc, credit card, stack of paper, etc.) that are placed in the throat 22 of the shredder 10. In embodiments that have thickness sensors 30, the thickness sensors 30 may be located above the alignment sensors 32 configured to sense the insertion of the articles into the throat 22. The alignment sensors 32 may be used to determine the angle in which the articles 18 are inserted into the throat 22. The angles are measured from a plane normal to the bottom edge of the paper. As such, when the articles 18, such as paper, are inserted into the throat 22 at an angle of about zero degrees, the article 18 is considered to be inserted into the throat 22 with perfect alignment. Articles 18 inserted into the throat 22 at an angle at or below the predetermined angle threshold may be considered to be properly aligned.

Each thickness sensor 30 may include a contact member 27 that extends into the throat 22 and is actuated in response to the article 18 being inserted into the throat 22. Each thickness sensor 30 may include a strain gauge configured to measure movement of the contact member 27 and communicate the movement to a controller 25. In one embodiment, the thickness sensor 30 may include an optical, sensor configured to measure movement of the contact member 27 and communicate the movement to a controller 25. The optical sensor may include an infrared sensor and a dual die infrared receiver configured to detect the direction and amount of the movement. In another embodiment, each thickness sensor 30 may include a piezoelectric sensor configured to measure movement of the contact member 27 and communicate the movement to a controller 25. Reference may be made to U.S. Patent Application Publication No. 2006-0219827 A1, which is hereby incorporated by reference, for details of a sensor that is configured to detect a thickness of the at least one article 18 received by the throat 22. The sensors may have any construction or configuration, and the illustrated embodiment is not limiting. The thickness sensors 30 are optional, and may or may not be used in conjunction with the alignment sensors 32.

The thickness sensors 30 may be used to determine the thickness of the articles 18, and the controller 25, upon receiving the thickness of the article 18 from the thickness sensors 30, may prevent the operation of the cutter elements 26 if the thickness is above a predetermined maximum thickness threshold. Articles 18 with thickness above the predetermined maximum thickness threshold are likely cause jams and increase the wear and tear of the cutter elements 26. The predetermined maximum thickness threshold is generally used to indicate the "capacity" of the throat 22. The predetermined thickness threshold may be determined according to the methods disclosed in U.S. Patent Application Publication No. 2006-0219827, which is incorporated herein by reference in its entirety.

In the embodiment shown in FIG. 4, the alignment sensors 32 are provided along the throat 22 below the thickness sensors 30 and are configured to detect insertion of the articles 18 and to determine misfeeds of the articles 18. The alignment sensors 32 may be optical sensors comprising a transmitter on one side of the throat and a receiver on the other side of the throat. The transmitter transmits electromagnetic radiation, such as an infrared beam to the receiver. It is also contemplated that radiation transmitted may include light in the visible spectrum and/or ultraviolet radiation. When a paper or other article 18 is inserted into the opening, it will interrupt the infrared beam and this is sensed by the receiver, which is communicated to the controller 25. The construction of such optical sensors is well-known and need not be detailed in this application. This configuration, arrangement, and type of the sensors is not intended to be limiting. The alignment sensors 32 may comprise of a variety of sensors, including optical sensors, mechanical sensors, contact switches, and other sensors known by one of ordinary skill in the art.

The configuration and arrangement of the thickness sensors 30 and alignment sensors 32 is not intended to be limiting. It is contemplated that in some embodiments, thickness sensors 30 are not used, and only alignment sensors 32 are used. It is also contemplated that the number of thickness sensors 30 and the location of the thickness sensors 30 may vary. For example, there may be one or more thickness sensors 30. In some embodiments, the thickness sensors 30 may be located below the alignment sensors 32.

In some embodiments, the sensors 30 and/or 32 may also act as activation sensors. When the switch is in its on (or idle) position, the controller 25 may be configured to operate the motor 13 to drive the cutter elements 26 of the shredder mechanism 17 in the shredding direction when the sensors 30 and/or 32 detect the presence or insertion of the at least one article 18 to be shredded. Having the sensors 30 and/or 32 activate the shredder 10 is desirable because it allows the user to ready the shredder 10 by moving the switch to its on position, but the controller 25 will not operate the shredder mechanism 17 to commence shredding until the sensors 30 and/or 32 detects the presence or insertion of one or more articles 18 in the throat 22. Once the at least one article 18 has passed into the shredder mechanism 17 beyond the sensors 30 and/or 32, the controller 25 will then stop the movement or rotation of the cutter elements 26 of shredding mechanism 17, as that corresponds to the articles having been fully fed and shredded. Typically, a slight delay in time, such as 3-5 seconds, is used before stopping the shredder mechanism 17 to ensure that the articles 18 have been completely shredded by the cutter elements 26 and discharged from the shredder mechanism 17. The use of such sensors 30 and/or 32 to activate the shredder mechanism 17 is beneficial because it allows the user to perform multiple shredding tasks without having the shredder mechanism 17 operating, making noise, between tasks. It also reduces wear on the shredder mechanism 17, as it will only operate when substrates are fed therein, and will not continually operate.

Figure 5:
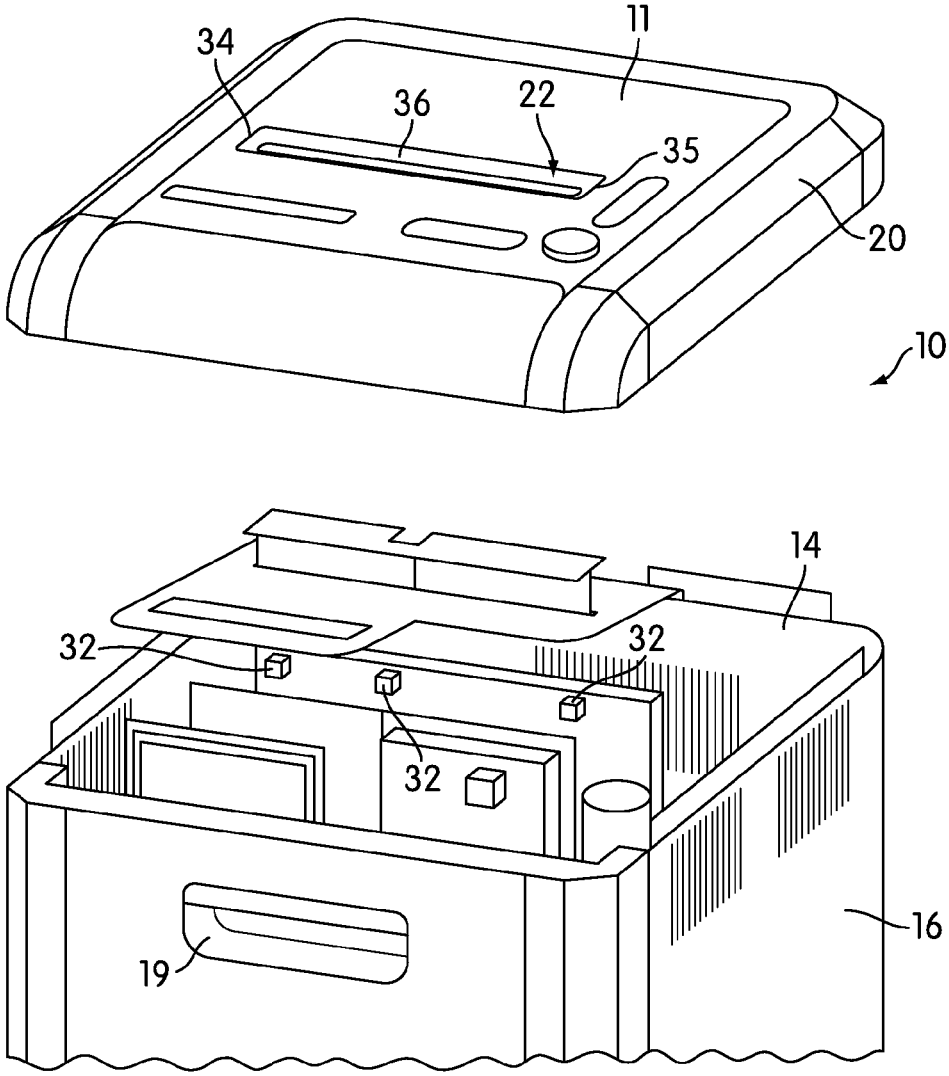
FIG. 5 is a perspective view of an embodiment with a top removed to show the placement of the sensors.

FIG. 5 illustrates an embodiment of the shredder 10 with the cover 11 removed to show the alignment sensors 32. In this embodiment, three alignment sensors 32 are provided along the throat 22 of the shredder 10. The throat 22 includes two ends 34 and 35 and a top 36.

The alignment sensors 32 may be placed along the throat 22 in positions determined by the throat 22 width and height such that at least a minimum number, such as three, alignment sensors 32 are able to sense the articles 18 when the articles 18 are properly aligned and are in contact with either end 34 or 35 of the throat 22. For wider throats, a greater number of alignment sensors 32 may be necessary for a minimum required number of alignment sensors 32 (e.g., all of the sensors 32) to be able to sense the insertion of the articles 18. The minimum required number of alignment sensors 32 may vary and may depend on the width and height of the throat, the placement and arrangement of the sensors 32, and the predetermined angle threshold. (As used herein, width refers to the long direction of the throat 22, i.e., in the width direction of a piece of paper being inserted therein; height refers to the distance from the top of the shredder cutter elements 26 to the top of the throat 22; and thickness is the short dimension of the throat 22, i.e., in the direction of the thickness of a stack of documents). The minimum required number of alignment sensors 32 may be determined using rules, logic and/or software. It is contemplated that the placement of the alignment sensors 32 along the throat may vary. Rules, logic, and/or software may be used to determine the placement, arrangement, and location of the alignment sensors 32 according to the width and height of the throat 22 and the predetermined angle threshold. For example, in one embodiment, when the predetermined angle threshold is increased and the throat width remains the same, the alignment sensors 32 may be placed closer towards each other (e.g., the distance between the left most and right most sensor 32 may be shorter) and closer towards the center line A (see FIG. 6) of the throat 22. When the throat 22 width is increased and the predetermined angle threshold remains the same, the alignment sensors 32 may also be placed closer towards the center line A of the throat 22.

Figure 6:
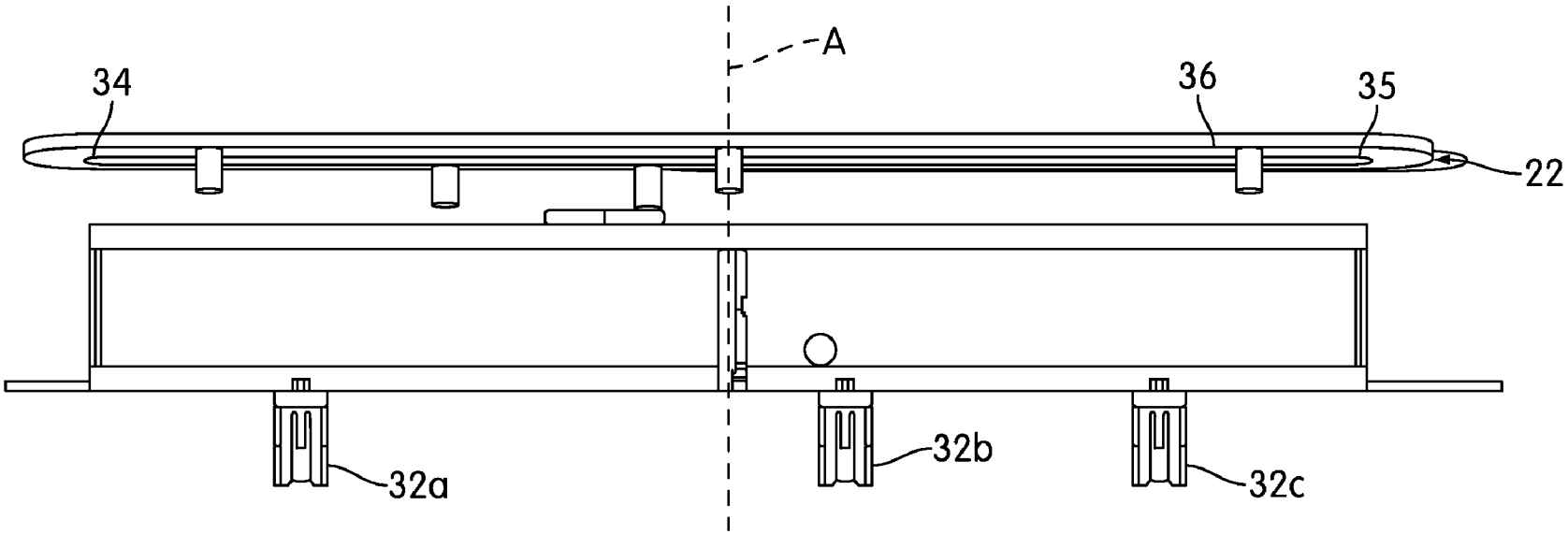
FIG. 6 is a view of an arrangement and configuration of alignment sensors in accordance with one embodiment.

In the embodiment shown in FIG. 6, the three alignment sensors 32 are sensor 32*a*, sensor 32*b*, and sensor 32*c*. In this embodiment, the minimum required number of sensors is three such that all three sensors 32*a*, 32*b*, and 32*c* must sense the article 18 for the angle of insertion to be determined to be at or below the predetermined angle threshold. The sensors 32*a*, 32*b*, and 32*c* are infrared sensors that are placed along the throat 22. The distance of each sensor 32*a*, 32*b*, or 32*c* from the ends 34 and 35 may be chosen such that a properly aligned sheet of North American "letter" paper (8½ in×11 in) that is in contact with either end 34 or 35 of the throat 22 may be sensed by all three sensors 32*a*, 32*b*, and 32*c*. In one embodiment, for articles 18, such as paper, to be sensed by all three sensors 32*a*, 32*b*, and 32*c* when the articles 18 are inserted into the throat at an angle below the predetermined angle threshold, the distance from the sensor 32*c* to the end 34 may not exceed 8.072 inches. Similarly, the distance from the sensor 32*a* to the end 35 may not exceed 8.072 inches. The placement of the sensors 32*a*, 32*b*, and 32*c* along the throat 22 are determined using rules, logic, and/or software based on the width and height of the throat 22 and the predetermined angle threshold. In this embodiment, the sensor 32*b* is the main sensor, and will usually be the first to sense the articles 18 being inserted into the throat 22. Thus, sensor 32*b* may be the activation sensor. The sensors 32*a* and 32*c* may be auxiliary sensors, and may be used in addition to the sensor 32*b* to determine whether the articles 18 are inserted into the throat 22 at an angle above the predetermined angle threshold.

Figure 7:
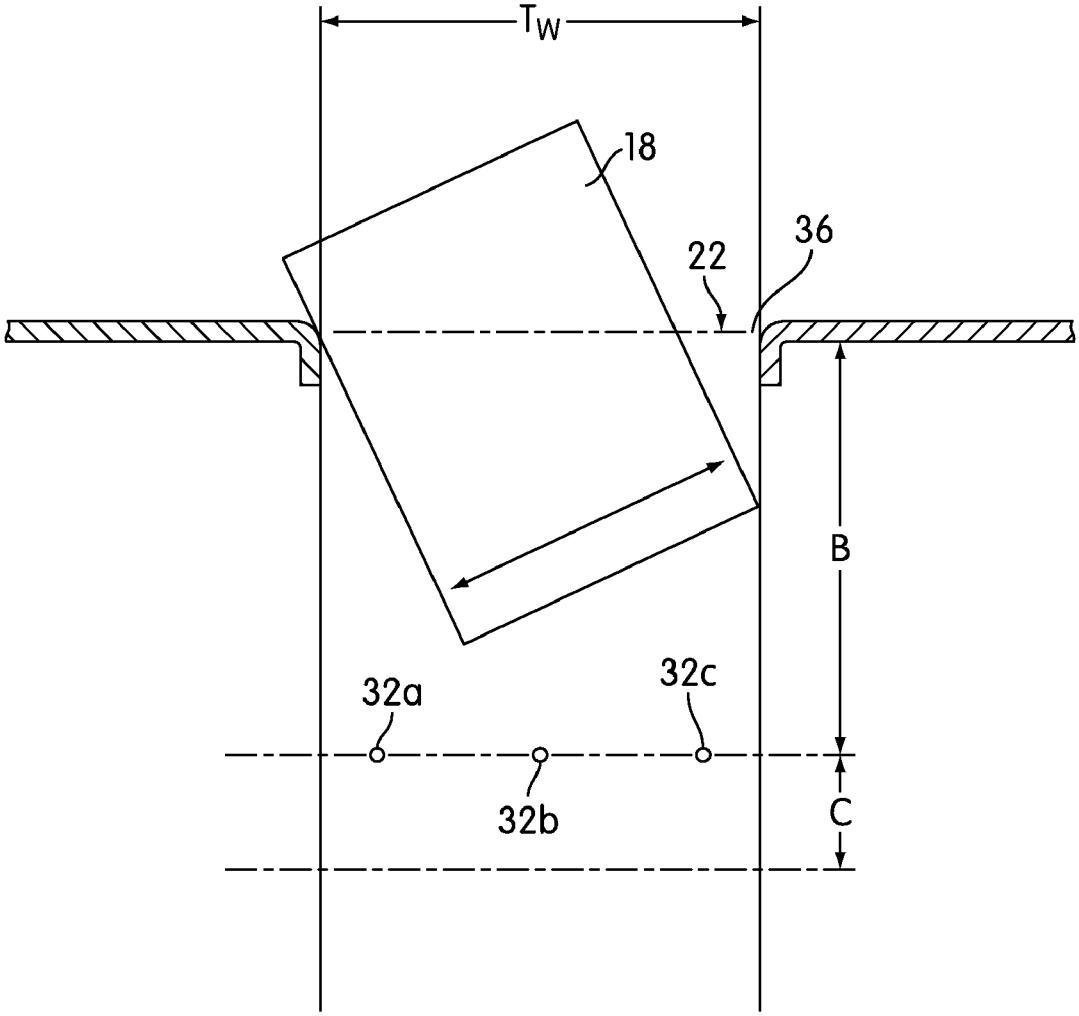
FIG. 7 is an illustration of an article being inserted into a throat of an embodiment.

The vertical placement of the sensors 32*a*, 32*b*, and 32*c* may also vary and may depend on the width and height of the throat and the predetermined angle threshold. For example, the sensor 32*b* may be located at the same horizontal level (same height) as or above the sensors 32*a* and 32*c*. In the embodiment shown in FIG. 7, distance B is the distance between the top 36 of the throat 22 and the sensor 32*a*, 32*b*, or 32*c* farthest from the top 34. Distance C is the distance from the same sensor 32*a*, 32*b*, or 32*c* to the cutter contact point (the point at which the cutter elements 26 first contacts at least a portion of the article 18). When improperly aligned articles 18 are inserted into the throat 22 and the Distance C is minimal, the user may rotate the articles 18 into proper alignment by pushing the articles 18 against the cutter elements 26 with a corner of the articles 18 acting as a fulcrum point against the cutter elements 26. Accordingly, all of the sensors 32*a*, 32*b*, and 32*c* may then sense the properly aligned articles 18. If all of the sensors 32*a*, 32*b*, 32*c* sense the articles 18, indicating that the articles 18 are at or below the predetermined angle threshold, then the controller 25 may direct the motor 13 to operate the cutter elements 26 to shred the article 18. If not all of the sensors 32*a*, 32*b*, and 32*c* sense the articles 18, then the controller 25 may prevent the motor 13 from driving the cutter elements 26. In some embodiments, the controller 25 may reverse direction of the motor 13 in response to at least one sensor 32*a*, 32*b*, and 32*c* not sensing the articles 18. In other embodiments, the vertical placement of the sensors 32 may vary and may be determined by rules, logic, and/or software.

In some embodiments, shredder 10 may include both thickness sensors 30 and alignment sensors 32. In the embodiment shown in FIG. 4, the thickness sensors 30 (one is shown) are above the alignment sensors 32. It is contemplated that the thickness sensors 30 and alignment sensors 32 may have other configurations and arrangements. For example, the thickness sensors 30 may be on the same level as or may be below the alignment sensors 32. In embodiments with thickness sensors 30 being below the alignment sensors 32, there should be a slight delay in time for the controller 25 to determine the thickness of the articles 18 before directing the motor 13 to operate the shredder elements 26. Furthermore, in embodiments where the thickness sensors 30 are below the alignment sensors 32, the thickness sensors 30 may be used as activation sensors.

In the embodiment shown in FIG. 4, each of the alignment sensors 32 are placed below the contact member 27 of the thickness sensor 30. In some embodiments, at least one of the alignment sensors 32 may be placed as close to the thickness sensors 30 as possible, but below the contact member 27 of the thickness sensor 30. In this embodiment, when the articles 18 are inserted into the throat 22, the thickness sensors 30 sense the articles 18. If the thickness sensors 30 sense that the articles 18 are below a predetermined minimum thickness threshold, then not all of the minimum required number of the alignment sensors 32 must be blocked for the controller 25 to direct the motor 13 to operate the cutter elements 26. In other words, the sensing pattern of the alignment sensors 32 can be ignored or bypassed. For example, in the embodiment shown in FIG. 6, all three sensors 32*a*, 32*b*, and 32*c* do not have to sense the articles 18 for the articles 18 to be shredded if the thickness sensors 30 sense that the articles 18 have a thickness below the predetermined minimum thickness threshold. This is useful for smaller articles (articles with less width), such as envelopes, where the shredder 10 can handle the thickness even if the article 18 is improperly aligned. Such smaller articles 18 might not be able to be sensed by the minimum required number of the alignment sensors 32 when such articles 18 that are properly aligned are inserted into the throat 22. In shredders with the thickness sensors 30, such smaller articles 18, as long as their thickness is not above the predetermined minimum thickness threshold, will be shred anyway.

Articles 18 with thickness that is at or below the predetermined minimum thickness threshold are not likely to cause jams or generate enough wear and tear on the cutter elements 26 for their alignment to be of concern. In contrast, articles 18 with thickness above the predetermined maximum thickness threshold are likely to cause jams and increase the wear and tear of the cutter elements 26. In one embodiment, for articles 18 with thickness that is above the predetermined maximum thickness threshold, the controller 25 will not direct the motor 13 to operate the cutter elements 26 regardless of whether the articles 18 are properly aligned.

In one embodiment, where the thickness sensor 30 senses that the thickness of the articles 18 is above the predetermined minimum thickness threshold but is at or below the predetermined maximum thickness threshold, the minimum required number of sensors 32 must sense the article 18 for the article 18 to be shred. Such a situation may be a stack of articles 18, such as paper sheets, that are below the predetermined maximum thickness threshold, but that may exceed the predetermined maximum thickness threshold if they become crumpled or folded during shredding due to misalignment. For example, in one embodiment, the alignment sensors 32 may have the arrangement as shown in FIG. 6. In this embodiment, the thickness sensors 30 sense the thickness of the articles 18 inserted into the throat 22. If the thickness of the article 18 is above the predetermined minimum thickness threshold but is at or below the predetermined maximum thickness threshold, then all three alignment sensors 32 must sense the article 18 for the controller 25 to continue directing the motor 13 to drive the cutter elements 26.

It is contemplated that in one embodiment, the alignment sensors 32 comprise thickness sensors 30, such that the thickness sensors 30 are used to sense the thickness of the articles 18 as well as to determine whether the angle of insertion is at or below the predetermined angle threshold. It is also contemplated that in some embodiments, there may be separate throats 22 or slots that may be placed over the throats 22 for receiving small documents, such as envelopes, and compact discs and/or credit cards, such that the use of the alignment sensors 32 and/or thickness sensors 30 may be bypassed. The controller 25 may also be configured such that the controller 25 may enable the operation of the shredder mechanism 17 to commence shredding when signaled by external controls, such as the override switch or a button that may be activated manually by the user. This may be especially useful in embodiments without thickness sensors 30 (e.g., embodiments having timers).

In some embodiments, a timer (not shown) is used with the alignment sensors 32. In one embodiment, the controller 25 may include a timer circuit, such as a 555 timer. The alignment sensors 32 may sense the article 18 at different time periods, depending on the location of the sensors 32 and the angle at which the article 18 is inserted into the throat 22. The sensors 32 sensing the article 18 at different time periods with a time period between the sensings being above a predetermined time threshold is indicative that the angle at which the article 18 is inserted is above the predetermined angle threshold.

Logic, rules, and/or software may be used to determine the predetermined time threshold depending on the placement of the sensors 32 and the predetermined angle threshold. For example, if the predetermined angle threshold remains the same and the distance between the sensors 32 is decreased (the left most sensor 32 and the right most sensor 32 are closer), the predetermined time threshold is also decreased. If the predetermined angle threshold remains the same and the distance between the sensors 32 is increased (the left most sensor 32 and the right most sensor 32 are farther apart), the predetermined time threshold is also increased. Alternatively, if the arrangement and configuration of the sensors 32 remain the same (the distance between the sensors 32 remain the same) and the predetermined angle threshold is increased, the predetermined time threshold is also increased. If the arrangement and configuration of the sensors 32 remain the same (the distance between the sensors 32 remain the same) and the predetermined angle threshold is decreased, the predetermined time threshold is also decreased.

The predetermined time threshold may vary depending on the placement of the sensors 32 and the predetermined angle threshold. In one embodiment, each of the alignment sensors 32 must sense the article 18 within the predetermined time threshold for the controller 25 to direct the motor 13 to drive the cutter elements 26. For example, in one embodiment that includes three alignment sensors 32, the time period between the first sensing and the third sensing must be at or below the predetermined time threshold for the cutter elements 26 to operate. If there are only two sensings (only two sensors 32 sense the article 18), the cutter elements 26 will not operate. If the time period between the first sensing and the third sensing is above the predetermined time threshold, the cutter elements 26 will not operate. It is contemplated that in other embodiments, especially embodiments having wider throats 22 and more sensors 32, fewer than all of the sensors 32 are required to sense the articles 18 for the cutter elements 26 to operate.

It is contemplated that in some embodiments, there may be a predetermined maximum time threshold such that if the time period between the sensings is above a predetermined maximum time threshold, the shredder 10 will shred the articles 18. A time period between sensings being above a predetermined maximum time threshold may be indicative of a smaller article 18 (one that is not wide enough to be sensed by all of the sensors 32) being inserted in first and another article 18 being inserted in after.

Moreover, in some embodiments, there may be a user indicator that provides a warning signal to the user, such as an audible signal and/or a visual signal. The controller 25 may be configured to output the visual or audible signal responsive to the sensors sensing that the article is inserted at an angle above a predetermined angle threshold. Examples of audible signals include, but are not limited to beeping, buzzing, and/or any other type of signal that will alert the user that the stack of documents or other article 18 that is about to be shredded is being inserted at an angle likely to cause jamming. This gives the user the opportunity to re-insert the articles or reconsider forcing the misaligned article through the shredder, knowing that any such forcing may jam and/or damage the shredder. A visual signal may be provided in the form of a red warning light, which may be emitted from an LED. It is also contemplated that a green light may also be provided to indicate that the shredder 10 is ready to operate.

Figure 8:
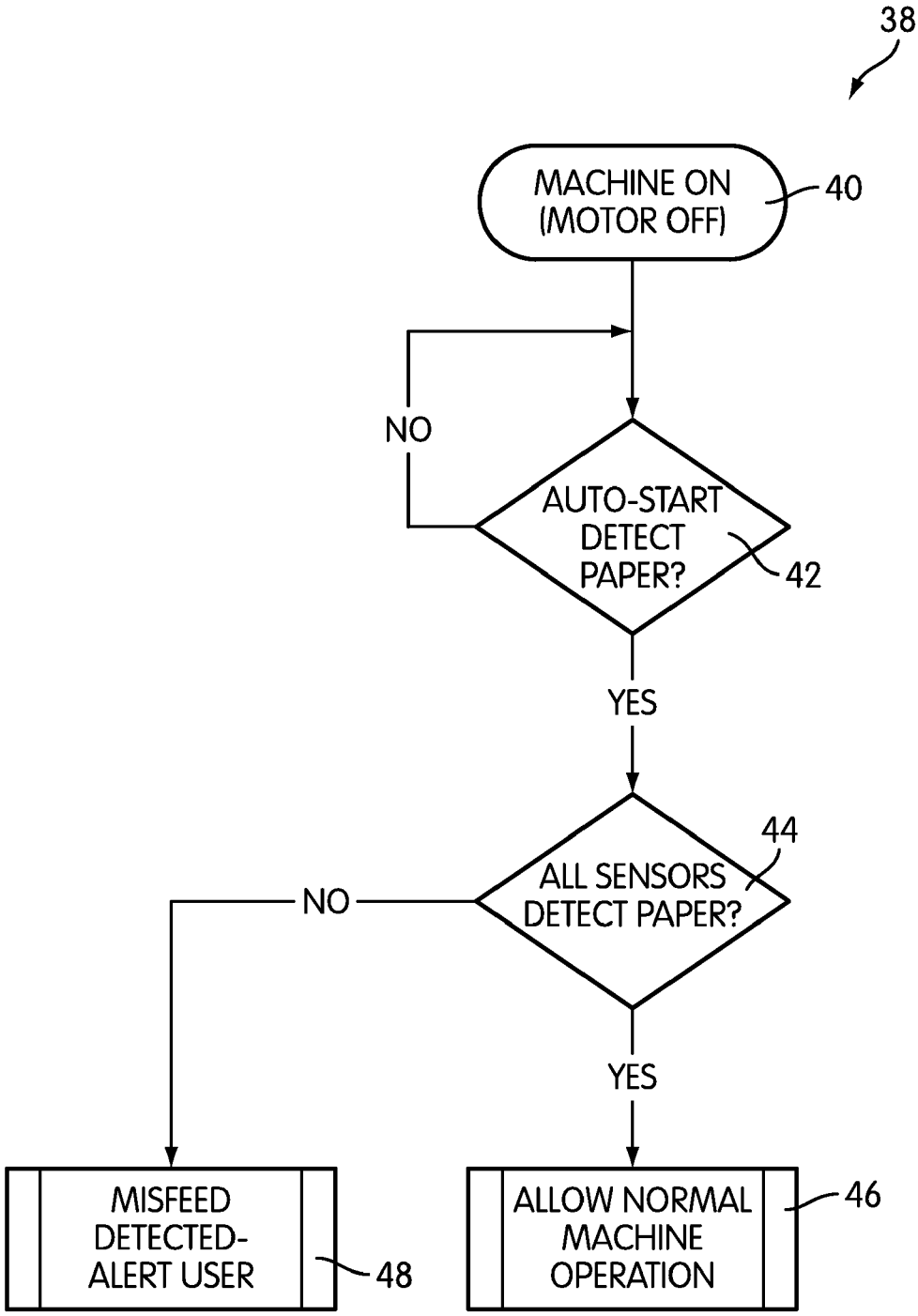
FIG. 8 is a flow diagram illustrating a method for operating an embodiment having alignment sensors.

FIG. 8 shows a method 38 for operating a shredder 10 having alignment sensors 32, but not having timers or thickness sensors 30, in accordance with one embodiment. The method 38 starts at procedure 40 where the shredder 10 is on (or in the idle mode). The method 38 proceeds to procedure 42 where the controller 25 determines whether the activation sensors, such as one or more of the alignment sensors 32, has sensed the articles 18. If the activation sensors have not sensed the articles 18, then the method 38 does not proceed until the activation sensors have sensed the article 18. Once the activation sensors have sensed the article 18, the method 38 proceeds to procedure 44. In procedure 44, the controller 25 determines whether the minimum required number of sensors 32 (e.g., all of the alignment sensors 32) have sensed the article 18. If the minimum required number of sensors 32 have sensed the article 18, this is indicative that the article 18 is not inserted into the throat 22 at an angle that is above the predetermined angle threshold. Thus, if the minimum required number of sensors 32 have sensed the article 18, then the method proceeds to procedure 46 where the controller 25 directs or continues to direct the motor 13 to drive the cutter elements 26. If the controller 25 determines that fewer than the minimum required number of sensors 32 have sensed the articles 18 (e.g., not all of the sensors 32 have sensed the articles 18), then the method 38 proceeds to procedure 48 where the controller 25 prevents the motor 13 from driving the cutter elements 26. In some embodiments, warnings signals may be generated to alert the user.

Figure 9:
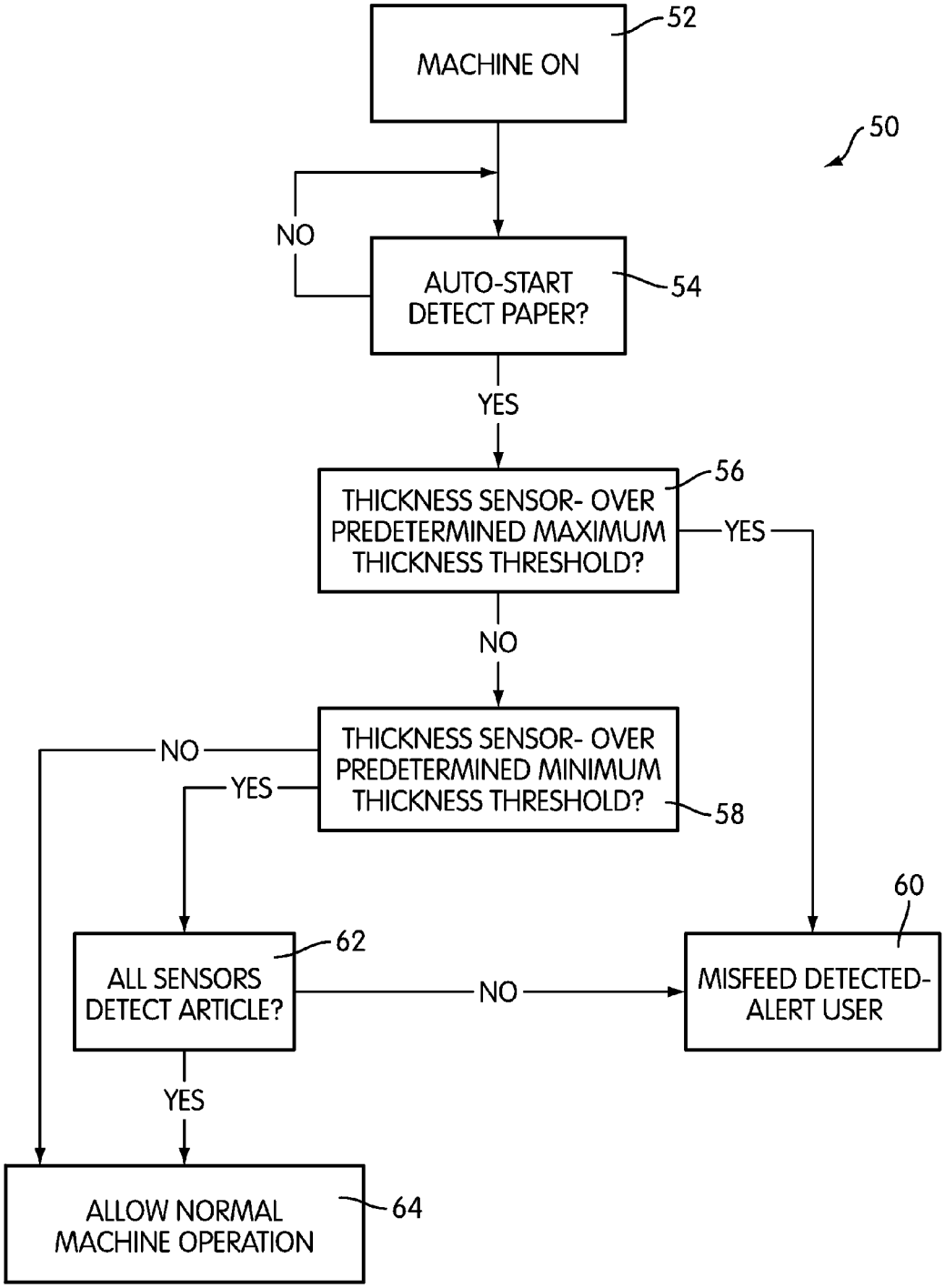
FIG. 9 is a flow diagram illustrating a method for operating an embodiment having alignment sensors and thickness sensors.

FIG. 9 shows a method 50 for operating a shredder 10 having alignment sensors 32 and thickness sensors 30 in accordance with one embodiment. The method 50 starts at procedure 52 where the shredder 10 is on (or in the idle mode). The method 50 proceeds to procedure 54 where the controller 25 determines whether the activation sensors, such as one or more of the alignment sensors 32, have sensed the articles 18. If the activation sensors have not sensed the articles 18, then the method 50 does not proceed until the activation sensors have sensed the articles 18. Once the activation sensors have sensed the articles 18, the method 50 proceeds to procedure 56. In procedure 56, the controller 25 determines if the thickness of the articles 18 sensed by the thickness sensors 30 is at, above, or below the predetermined maximum thickness threshold. If the thickness is above the predetermined maximum thickness threshold, then the method 50 proceeds to procedure 60 where the controller 25 prevents the motor 13 from operating the cutter elements 26. A warning signal may be generated and displayed. If the thickness is at or below the predetermined maximum thickness threshold, the method 50 proceeds to procedure 58 where the controller 25 determines if the thickness is at, below, or above the predetermined minimum thickness threshold. If the thickness is at or below the predetermined minimum thickness threshold, the method 50 proceeds to procedure 64 where the articles 18 are shredded. In procedure 64, the controller 25 may direct or continue to direct the motor 13 to drive the cutter elements 26. If the thickness is above the predetermined minimum thickness threshold, the method 50 proceeds to procedure 62 where the controller 25 determines if the minimum required number of sensors 32 (e.g., all of the sensors 32) have sensed the article 18. If the controller 25 determines that the minimum required number of sensors 32 have sensed the articles 18, the method 50 proceeds to procedure 64 wherein the articles 18 are shredded. In procedure 62, if the controller 25 determines that the minimum required number of sensors 32 have not sensed the articles 18, the method 50 proceeds to procedure 60 where the controller 25 prevents the motor 13 from operating the cutter elements 26.

Figure 10:
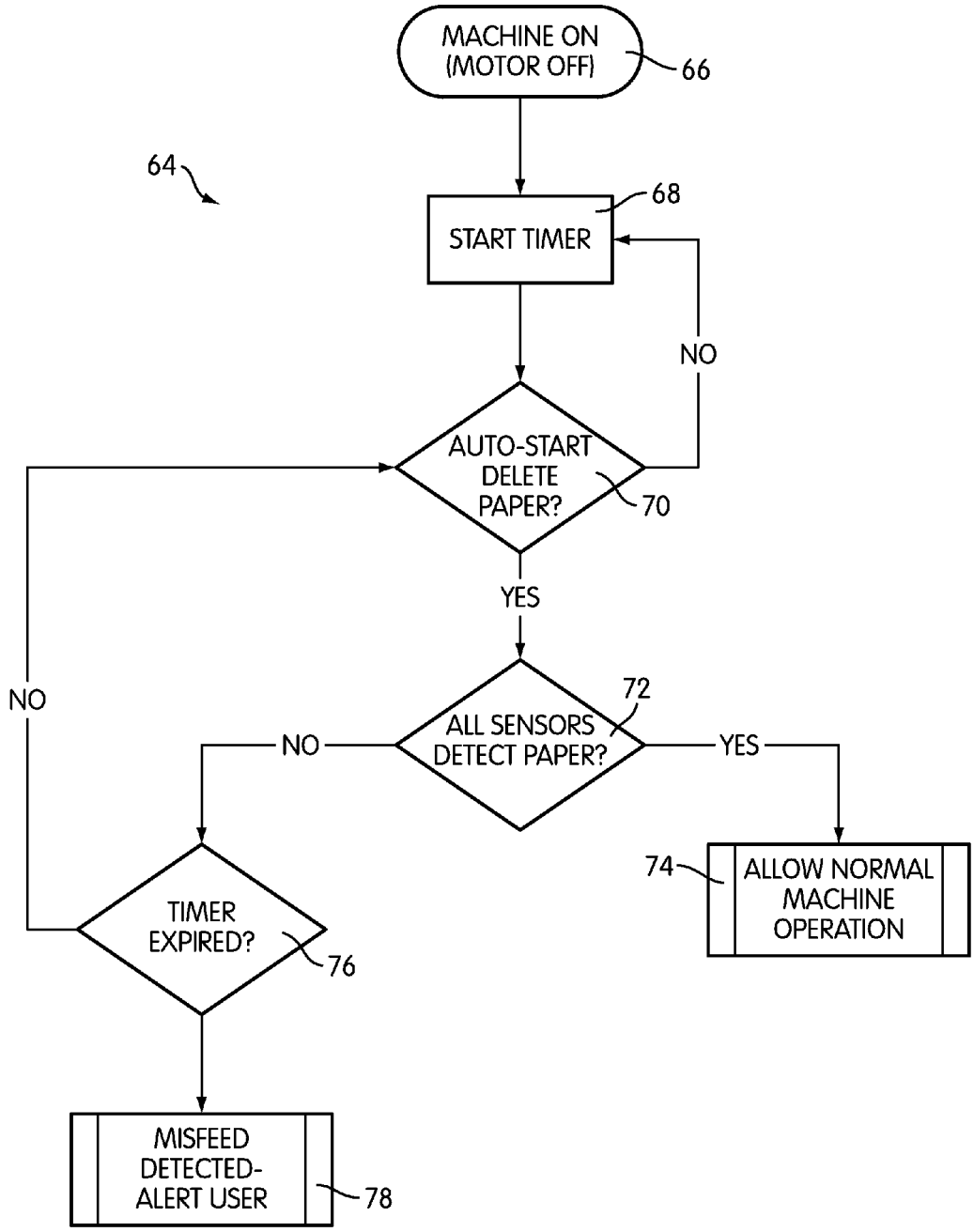
FIG. 10 is a flow diagram illustrating a method for operating an embodiment having alignment sensors and a timer.

FIG. 10 shows a method 64 for operating a shredder 10 having alignment sensors 32 and a timer in accordance with one embodiment. The method 64 starts at procedure 66 where the shredder 10 is on (or in the idle mode). The method 64 proceeds to procedure 68 where the timer is initialized. The method 64 then proceeds to procedure 70 where the controller 25 determines whether the activations sensors, such as one or more of the alignment sensors 32, have sensed the articles 18. If the activation sensors have not sensed the articles 18, then the method 64 does not proceed until the activation sensors have sensed the articles 18 and the method 64 proceeds back to procedure 68 to start the timer. Once the activation sensors have sensed the articles 18, the method 64 proceeds to procedure 72. In procedure 72, the controller 25 determines if the minimum required number of sensors 32 (e.g., all of the sensors 32) have sensed the articles 18. If the minimum required number of sensors 32 have sensed the articles 18, then the method proceeds to procedure 74 wherein the articles 18 are shred. If the minimum required number of sensors 32 have sensed the articles 18, then the method proceeds to procedure 74 wherein the articles 18 are shredded. If the minimum required number of sensors 32 have not sensed the articles 18, the method 64 proceeds to procedure 76 where the controller 25 determines if the predetermined time threshold has elapsed. If the predetermined time threshold has not elapsed, the method 64 proceeds back to procedure 70 where the controller 25 determines if the activation sensors have sensed the articles 18. As long as the predetermined time threshold has not elapsed, the method 64 may proceed back to procedure 70. However, in procedure 76, if the controller 25 determines that the predetermined time threshold has elapsed before the minimum required number of sensors 32 have sensed the articles 18, then the method 64 proceeds to procedure 78 where the controller 25 prevents the motor 13 from operating the cutter elements 26. A warning signal may also be generated.

Moreover, the sensors 30 and/or 32 may be self-calibrating or self-adjusting to reduce wear and run-on conditions, as described in U.S. patent application Ser. No. 12/252,158, which is incorporated herein in its entirety by reference. In some embodiments, the emission of radiation from the sensors 30 and/or 32 provides certain levels of intensity (or brightness) of light. However, due to aging, misalignment, variances in tolerances, and/or different sensor grades, the intensity or brightness of the light beam or radiation emitted from the sensors 30 and/or 32 is altered. For example, the intensity of the emitter may decrease due to age and addition of dust or residue on and around the components. A decrease in intensity is indicative of that the sensor's performance is declining. When the perceived intensity of the emitter is reduced (i.e., perceived by the sensors 30 and/or 32), false positive signals may be sent from the controller 25, thus creating a "run-on" condition for the shredder 10. In order to compensate for the required characteristics, sensitivities, and other features of the sensors 30 and/or 32, the intensity of the radiation emitted by the sensors 30 and/or 32 is adjusted and modified so that the sensors 30 and/or 32 are capable of detecting such previously described events. For example, with regard to the sensors 30 and/or 32, the intensity of the radiation beam is adjusted so that the sensors 30 and/or 32 are capable of interruption of the radiation by (a) at least a single sheet of paper being inserted into the throat 22 and/or (b) a plurality of accumulated shredded particles discharged by the shredder mechanism 17. Specifically, the sensors 30 and/or 32 of the shredder 10 are calibrated to improve its performance.

The foregoing illustrated embodiments have been provided to illustrate the structural and functional principles of the present invention and are not intended to be limiting. To the contrary, the present invention is intended to encompass all modifications, alterations and substitutions within the spirit and scope of the appended claims.

What is claimed is:

1. A shredder comprising:

a housing having a throat for receiving at least one sheet of paper to be shredded;

a shredder mechanism received in the housing, the shredder mechanism including a motor and cutter elements, the shredder mechanism enabling the at least one sheet of paper to be shredded to be fed into the cutter elements and the motor being operable to drive the cutter elements in a shredding direction so that the cutter elements shred the at least one sheet of paper fed therein into shredded particles;

a plurality of sensors provided along the throat and each configured to sense insertion of the at least one sheet of paper into the throat; and a controller coupled to the motor and the sensors, the controller being configured to perform a predetermined motor control operation of the motor responsive to the sensors sensing the at least one sheet of paper inserted into the throat at an angle above a predetermined angle threshold.

2. A shredder according to claim 1, wherein the controller is configured to determine if the angle is above the predetermined angle threshold by comparing an output of each sensor against a predetermined sensing pattern.

3. A shredder according to claim 2, wherein the predetermined sensing pattern includes a predetermined time threshold between sensings by the sensors, and wherein the controller is configured to determine that the angle is above the predetermined angle threshold when a time period between sensings is above the predetermined time threshold.

4. A shredder according to claim 3, and further comprising a user indicator configured to output a visual or audible signal to a user, wherein the controller is further configured to output the visual or audible signal responsive to the sensings being above the predetermined time threshold.

5. A shredder according to claim 2, wherein the predetermined sensing pattern is a predetermined number of the sensors sensing the at least one sheet of paper, and wherein the controller is configured to determine that the angle is above the predetermined angle threshold by fewer than the predetermined number of sensors sensing the at least one sheet of paper.

6. A shredder according to claim 5, and further comprising a user indicator configured to output a visual or audible signal to a user, wherein the controller is further configured to output the visual or audible signal responsive to fewer than the predetermined number of sensors sensing insertion of the at least one sheet of paper.

7. A shredder according to claim 1, wherein the controller is configured to prevent the motor from driving the cutter elements as the predetermined motor operation.

8. A shredder according to claim 1, wherein the controller is configured to reverse direction of the motor as the predetermined motor control operation.

9. A shredder according to claim 1, wherein the controller comprises a timer.

10. A shredder according to claim 1, further comprising at least one thickness sensor configured to sense a thickness of the at least one sheet of paper being received by the throat.

11. A shredder according to claim 10, wherein the controller is further configured to perform the predetermined motor control operation responsive to the thickness sensor or thickness sensors sensing that the thickness of the at least one sheet of paper is greater than a predetermined maximum thickness threshold.

12. A shredder according to claim 1, further comprising a container for receiving the at least one shredded sheet of paper or shredded particles.

13. A shredder according to claim 1, wherein the plurality of sensors comprises three or more sensors.

14. A shredder according to claim 1, wherein the plurality of sensors comprising optical sensors, each optical sensor comprising a transmitter on one side of the throat and a receiver on the other side of the throat, the transmitter transmitting electromagnetic radiation to the receiver and the receiver being communicated to the controller, each optical sensor detecting receipt of a portion of the at least one sheet of paper in the throat by the portion interrupting the electromagnetic radiation transmitted to the receiver.

15. A shredder according to claim 1, wherein the plurality of sensors comprises infrared sensors.

16. A shredder according to claim 1, wherein the plurality of sensors comprises contact switches.

17. A shredder comprising:

a housing having a throat for receiving at least one sheet of paper to be shredded;

a shredder mechanism received in the housing, the shredder mechanism including a motor and cutter elements, the shredder mechanism enabling the at least one sheet of paper to be shredded to be fed into the cutter elements and the motor being operable to drive the cutter elements in a shredding direction so that the cutter elements shred the at least one sheet of paper fed therein into shredded particles;

a plurality of sensors spaced apart longitudinally along the throat and each configured to sense insertion of the at least one sheet of paper into the throat; and a controller coupled to the motor and the sensors, the controller being configured to perform a predetermined motor control operation of the motor responsive to the sensors sensing with a predetermined sensing pattern the at least one sheet of paper inserted into the throat.

18. A shredder according to claim 17, wherein the predetermined pattern includes a predetermined time threshold between sensings by the sensors, and wherein the controller is configured to perform the predetermined motor control operation responsive to a time period between sensings exceeding the predetermined time threshold.

19. A shredder according to claim 17, wherein the predetermined sensing pattern is a predetermined number of the sensors sensing the at least one sheet of paper, and wherein the controller is configured to perform the predetermined motor control operation responsive to fewer than the predetermined number of sensors sensing the at least one sheet of paper.

20. A shredder according to claim 17, wherein the predetermined sensing pattern is indicative of an angle at which the at least one sheet of paper is inserted into the throat, and wherein the controller is configured to perform the predetermined motor control operation responsive to the angle being above a predetermined angle threshold.

21. A method for operating a shredder comprising a housing having a throat for receiving at least one sheet of paper to be shredded, a plurality of sensors provided along the throat and configured to sense insertion of the at least one sheet of paper into the throat, a shredder mechanism received in the housing and including an electrically powered motor and cutter elements, the shredder mechanism enabling the at least one sheet of paper to be shredded to be fed into the cutter elements and the motor being operable drive the cutter elements in a shredding direction so that the cutter elements shred the sheet of papers fed therein, and a controller coupled to the motor and the sensors; the method comprising:

sensing with the plurality of sensors insertion of the at least one sheet of paper into the throat;

performing, by the controller, a predetermined motor control operation of the motor responsive to the sensors sensing the at least one sheet of paper inserted into the throat at an angle above a predetermined angle threshold.

22. A method according to claim 21, wherein the controller is configured to determine if the angle is above the predetermined angle threshold by comparing an output of each sensor against a predetermined sensing pattern.

23. A method according to claim 22, wherein the predetermined sensing pattern includes a predetermined time threshold between sensings by the sensors, and wherein the controller is configured to determine that the angle is above the predetermined angle threshold when a time period between sensings is above the predetermined time threshold.

24. A method according to claim 23, and further comprising outputting, by a user indicator, a visual or audible signal to a user, and wherein the visual or audible signal is outputted responsive to the sensings being above the predetermined time threshold.

25. A method according to claim 21, wherein the controller is configured to prevent the motor from driving the cutter elements as the predetermined motor operation.

26. A method according to claim 21, wherein the controller is configured to reverse direction of the motor as the predetermined motor control operation.

27. A method according to claim 21, wherein the controller comprises a timer.

28. A method according to claim 21, wherein the predetermined sensing pattern is a predetermined number of the sensors sensing the at least one sheet of paper, and wherein the controller is configured to determine that the angle is above the predetermined angle threshold by fewer than the predetermined number of sensors sensing the at least one sheet of paper.

29. A method according to claim 28, and further comprising outputting, by a user indicator, a visual or audible signal to a user, and wherein the visual or audible signal is outputted responsive to fewer than the predetermined number of sensors sensing insertion of the at least one sheet of paper.

30. A method according to claim 21, further comprising sensing, by at least one thickness sensor, a thickness of the at least one sheet of paper being received by the throat.

31. A method according to claim 30, further comprising performing, by the controller, the predetermined motor control operation responsive to the thickness sensor or thickness sensors sensing that the thickness of the at least one sheet of paper is greater than a predetermined maximum thickness threshold.

32. A method according to claim 21, further comprising receiving, by a container, the at least one shredded sheet of paper or shredded particles.

33. A method according to claim 21, wherein the plurality of sensors comprises three or more of the sensors provided along the throat.

34. A method according to claim 21, wherein the plurality of sensors comprising optical sensors, each optical sensor comprising a transmitter on one side of the throat and a receiver on the other side of the throat, the transmitter transmitting electromagnetic radiation to the receiver and the receiver being communicated to the controller, each optical sensor detecting receipt of a portion of the at least one sheet of paper in the throat by the portion interrupting the electromagnetic radiation transmitted to the receiver.

35. A method according to claim 21, wherein the plurality of sensors comprises infrared sensors.

36. A method according to claim 21, wherein the plurality of sensors comprises contact switches.

37. A method for operating a shredder comprising a housing having a throat for receiving at least one sheet of paper to be shredded, a plurality of sensors spaced apart longitudinally along the throat and configured to sense insertion of the at least one sheet of paper into the throat, and a shredder mechanism received in the housing and including an electrically powered motor and cutter elements, the shredder mechanism enabling the at least one sheet of paper to be shredded to be fed into the cutter elements and the motor being operable drive the cutter elements in a shredding direction so that the cutter elements shred the sheet of papers fed therein, and a controller coupled to the motor and the sensors; the method comprising:

sensing with the plurality of sensors insertion of the at least one sheet of paper into the throat; and performing, by the controller, a predetermined motor control operation of the motor responsive to the sensors sensing with a predetermined sensing pattern the at least one sheet of paper inserted into the throat.

38. A method according to claim 37, wherein the controller is configured to prevent the motor from driving the cutter elements as the predetermined motor operation.

39. A method according to claim 37, wherein the controller is configured to reverse direction of the motor as the predetermined motor control operation.

40. A method according to claim 37, wherein the controller comprises a timer.

41. A method according to claim 37, further comprising sensing, by a thickness sensor, a thickness of the at least one sheet of paper being received by the throat.

42. A method according to claim 41, wherein the controller is further configured to perform the predetermined motor control operation responsive to the thickness sensor or thickness sensors sensing that the thickness of the at least one sheet of paper is greater than a predetermined maximum thickness threshold.

43. A method according to claim 37, wherein the plurality of sensors comprises three or more of the sensors provided along the throat.

44. A method according to claim 37, wherein the plurality of sensors comprises infrared sensors.

45. A method according to claim 37, wherein the plurality of sensors comprises contact switches.

46. A method according to claim 37, wherein the predetermined sensing pattern is indicative of an angle at which the at least one sheet of paper is inserted into the throat, and wherein the controller is configured to perform the predetermined motor control operation responsive to the angle being above a predetermined angle threshold.

47. A method according to claim 46, wherein the predetermined sensing pattern includes a predetermined time threshold between sensings by the sensors, and where the controller is configured to determine that the angle is above the predetermined angle threshold when a time period between sensings is above a predetermined time threshold.

48. A method according to claim 47, and further comprising outputting, by a user indicator, a visual or audible signal to a user, and wherein the visual or audible signal is outputted responsive to the sensings being above the predetermined time threshold.

49. A method according to claim 46, wherein the predetermined sensing pattern is a predetermined number of the sensors sensing the at least one sheet of paper, and wherein the controller is configured to determine that the angle is above the predetermined angle threshold by fewer than the predetermined number of sensors sensing the at least one sheet of paper.

50. A method according to claim 49, further comprising outputting, by a user indicator, a visual or audible signal to a user, and wherein the visual or audible signal is outputted responsive to fewer than the predetermined number of sensors sensing insertion of the at least one sheet of paper.

51. A shredder comprising:

a housing having a throat for receiving at least one sheet of paper to be shredded;

a shredder mechanism received in the housing, the shredder mechanism including a motor and cutter elements, the shredder mechanism enabling the at least one sheet of paper to be shredded to be fed into the cutter elements and the motor being operable to drive the cutter elements in a shredding direction so that the cutter elements shred the at least one sheet of paper fed therein into shredded particles;

a plurality of sensors provided along the throat and each configured to sense insertion of the at least one sheet of paper into the throat; and a controller coupled to the motor and the sensors, the controller being configured to perform a predetermined motor control operation of the motor responsive to the sensors sensing with a predetermined sensing pattern the at least one sheet of paper inserted into the throat, wherein the predetermined pattern includes a predetermined time threshold between sensings by the sensors, and wherein the controller is configured to perform the predetermined motor control operation responsive to a time period between sensings exceeding the predetermined time threshold.

52. A shredder comprising:

a housing having a throat for receiving at least one sheet of paper to be shredded;

a shredder mechanism received in the housing, the shredder mechanism including a motor and cutter elements, the shredder mechanism enabling the at least one sheet of paper to be shredded to be fed into the cutter elements and the motor being operable to drive the cutter elements in a shredding direction so that the cutter elements shred the at least one sheet of paper fed therein into shredded particles;

a plurality of sensors provided along the throat and each configured to sense insertion of the at least one sheet of paper into the throat; and a controller coupled to the motor and the sensors, the controller being configured to perform a predetermined motor control operation of the motor responsive to the sensors sensing with a predetermined sensing pattern the at least one sheet of paper inserted into the throat, wherein the predetermined sensing pattern is a predetermined number of the sensors sensing the at least one sheet of paper, and wherein the controller is configured to perform the predetermined motor control operation responsive to fewer than the predetermined number of sensors sensing the at least one sheet of paper.

53. A shredder comprising:

a housing having a throat for receiving at least one sheet of paper to be shredded;

a shredder mechanism received in the housing, the shredder mechanism including a motor and cutter elements, the shredder mechanism enabling the at least one sheet of paper to be shredded to be fed into the cutter elements and the motor being operable to drive the cutter elements in a shredding direction so that the cutter elements shred the at least one sheet of paper fed therein into shredded particles;

a plurality of sensors provided along the throat and each configured to sense insertion of the at least one sheet of paper into the throat; and a controller coupled to the motor and the sensors, the controller being configured to perform a predetermined motor control operation of the motor responsive to the sensors sensing with a predetermined sensing pattern the at least one sheet of paper inserted into the throat, wherein the predetermined sensing pattern is indicative of an angle at which the at least one sheet of paper is inserted into the throat, and wherein the controller is configured to perform the predetermined motor control operation responsive to the angle being above a predetermined angle threshold.

54. A method for operating a shredder comprising a housing having a throat for receiving at least one sheet of paper to be shredded, a plurality of sensors provided along the throat and configured to sense insertion of the at least one sheet of paper into the throat, and a shredder mechanism received in the housing and including an electrically powered motor and cutter elements, the shredder mechanism enabling the at least one sheet of paper to be shredded to be fed into the cutter elements and the motor being operable drive the cutter elements in a shredding direction so that the cutter elements shred the sheet of papers fed therein, and a controller coupled to the motor and the sensors; the method comprising:

sensing with the plurality of sensors insertion of the at least one sheet of paper into the throat; and performing, by the controller, a predetermined motor control operation of the motor responsive to the sensors sensing with a predetermined sensing pattern the at least one sheet of paper inserted into the throat, wherein the predetermined sensing pattern is indicative of an angle at which the at least one sheet of paper is inserted into the throat and the controller performs the predetermined motor control operation responsive to the angle being above a predetermined angle threshold, wherein the predetermined sensing pattern includes a predetermined time threshold between sensings by the sensors, and wherein the controller determines that the angle is above the predetermined angle threshold when a time period between sensings is above a predetermined time threshold.

55. A method for operating a shredder comprising a housing having a throat for receiving at least one sheet of paper to be shredded, a plurality of sensors provided along the throat and configured to sense insertion of the at least one sheet of paper into the throat, and a shredder mechanism received in the housing and including an electrically powered motor and cutter elements, the shredder mechanism enabling the at least one sheet of paper to be shredded to be fed into the cutter elements and the motor being operable drive the cutter elements in a shredding direction so that the cutter elements shred the sheet of papers fed therein, and a controller coupled to the motor and the sensors; the method comprising:

sensing with the plurality of sensors insertion of the at least one sheet of paper into the throat;

performing, by the controller, a predetermined motor control operation of the motor responsive to the sensors sensing with a predetermined sensing pattern the at least one sheet of paper inserted into the throat, and outputting, by a user indicator, a visual or audible signal to a user, wherein the visual or audible signal is outputted responsive to the sensings being above the predetermined time threshold, wherein the predetermined sensing pattern is indicative of an angle at which the at least one sheet of paper is inserted into the throat and the controller performs the predetermined motor control operation responsive to the angle being above a predetermined angle threshold, wherein the predetermined sensing pattern includes a predetermined time threshold between sensings by the sensors, and wherein the controller determines that the angle is above the predetermined angle threshold when a time period between sensings is above a predetermined time threshold.

56. A method for operating a shredder comprising a housing having a throat for receiving at least one sheet of paper to be shredded, a plurality of sensors provided along the throat and configured to sense insertion of the at least one sheet of paper into the throat, and a shredder mechanism received in the housing and including an electrically powered motor and cutter elements, the shredder mechanism enabling the at least one sheet of paper to be shredded to be fed into the cutter elements and the motor being operable drive the cutter elements in a shredding direction so that the cutter elements shred the sheet of papers fed therein, and a controller coupled to the motor and the sensors; the method comprising:

sensing with the plurality of sensors insertion of the at least one sheet of paper into the throat; and performing, by the controller, a predetermined motor control operation of the motor responsive to the sensors sensing with a predetermined sensing pattern the at least one sheet of paper inserted into the throat, wherein the predetermined sensing pattern is indicative of an angle at which the at least one sheet of paper is inserted into the throat and the controller performs the predetermined motor control operation responsive to the angle being above a predetermined angle threshold, wherein the predetermined sensing pattern is a predetermined number of the sensors sensing the at least one sheet of paper, and wherein the controller determines that the angle is above the predetermined angle threshold by fewer than the predetermined number of sensors sensing the at least one sheet of paper.

* * * * *